United States Patent [19]

Wheeler

[11] Patent Number: 4,899,415

[45] Date of Patent: Feb. 13, 1990

[54] CLEANING ROD HANDLE

[75] Inventor: Raymond A. Wheeler, Lakeland, Fla.

[73] Assignee: Peace River Arms & Accessories, Inc., Lakeland, Fla.

[21] Appl. No.: 274,292

[22] Filed: Nov. 21, 1988

[51] Int. Cl.[4] ..... F41C 31/00

[52] U.S. Cl. ..... 15/104.05; 15/104.16; 16/110 R; 16/114 R; 81/438; 81/177.1

[58] Field of Search ..... 16/110 R, 114 R; 81/438, 177.1; 15/104.05, 104.16

[56] References Cited

U.S. PATENT DOCUMENTS

| | | | |
|---|---|---|---|
| 1,237,056 | 8/1917 | Kitchen | 15/104.16 |
| 1,251,247 | 12/1917 | Lanfranco | 15/104.05 |
| 1,469,792 | 10/1923 | Johnson | 81/438 |
| 1,665,257 | 4/1928 | Dake | 15/104.16 |
| 1,980,087 | 11/1934 | Rast | 145/61 |
| 2,592,978 | 4/1952 | Trimbuli | 81/177.1 |
| 2,697,642 | 12/1954 | Rudy | 16/114 R |
| 2,921,326 | 1/1960 | Lautmann | 15/145 |
| 3,894,807 | 7/1975 | Betz, III | 403/221 |
| 4,056,020 | 11/1977 | Coviello | 81/438 |
| 4,125,913 | 11/1978 | Lewis | 7/138 |
| 4,235,269 | 11/1980 | Kraus | 81/438 |
| 4,349,940 | 9/1982 | Fleischmann et al. | 16/114 |
| 4,525,889 | 7/1985 | Dunau | 15/146 |

*Primary Examiner*—Frankie L. Stinson

*Attorney, Agent, or Firm*—Warren L. Franz

[57] ABSTRACT

A multipurpose handle for a gun cleaning kit has a coaxially aligned bore in one end of a cylindrical member and a perpendicular bore centrally of the member for selective threaded engagement with a cleaning rod section, to serve as either a "push" handle or a "pull" handle for the rod. The other end of the member has a coaxially aligned hexagonal socket opening with a magnet at the bottom for holding and driving a matching hexagonal screwdriver bit. Another perpendicular bore located between the end bore and the central bore of the handle permits the rod section to be slid through the handle for increasing the torque applied to the screwdriver bit. The exterior of the handle is knurled for better gripping.

13 Claims, 1 Drawing Sheet

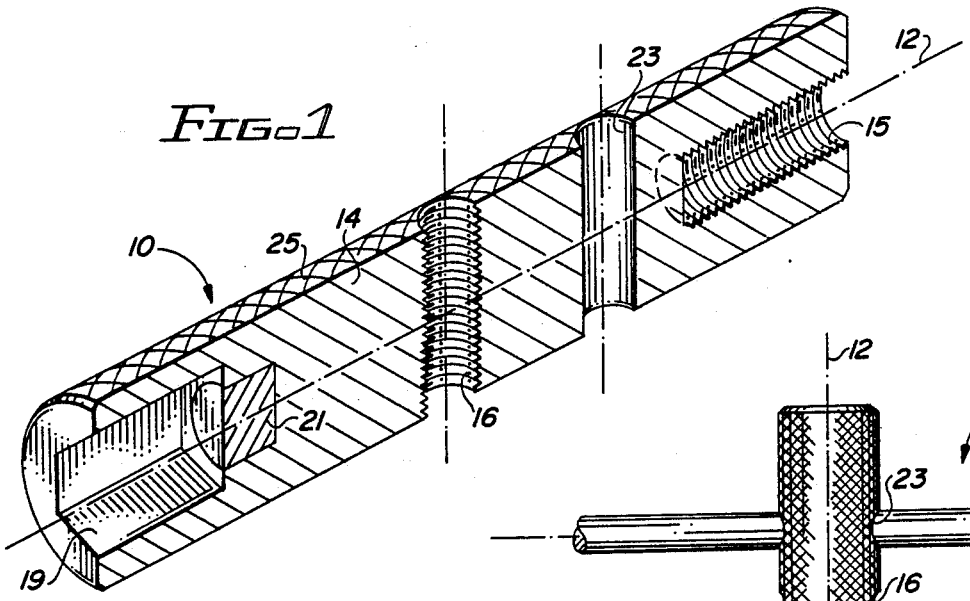
FIG. 1
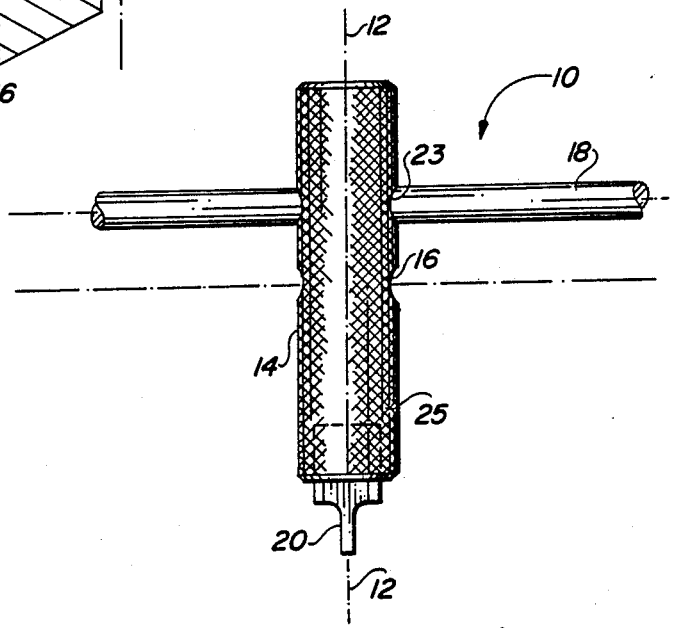
FIG. 4
FIG. 2
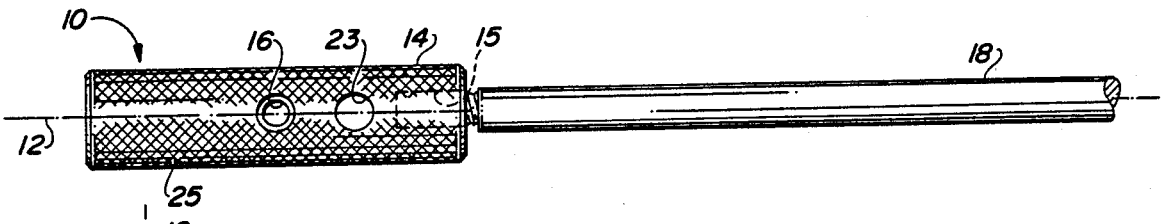
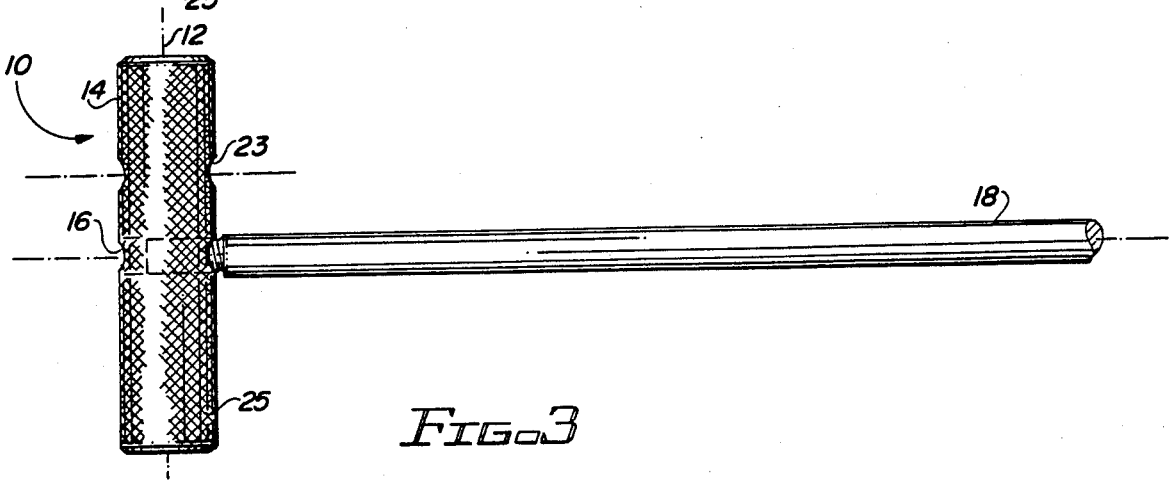
FIG. 3

CLEANING ROD HANDLE

This invention relates to a multipurpose handle for use in combination with cleaning rod sections of a gun cleaning tool, or the like.

BACKGROUND OF THE INVENTION

Proper care and maintenance of rifles, shotguns and pistols requires that gun bores and chambers be kept free from obstruction, cleaned and oiled. A typical gun cleaning kit comprises a multisection jointed rod of stainless steel, anodized aluminum or hard wood, with attached or separate palm-rest or straight stock handle, and a plurality of accessories such as slotted or jagged nylon tip, bronze brush, wool mop or swab, and the like. The rod sections and accessories are screwed together, with handle at one end and an accessory at the other for passage of the accessory from breech to muzzle of the gun bore and elsewhere, as desired, to brush and swab the same and to apply solvents, oils and other protective substances.

Handles used with metal rods tend to be of the palm-rest type, which screw on to the end of the connected rod sections to form a T-shaped handle at right angles to the rod shafts for pulling the brush, swab or patch back and forth through the barrel. Wood shotgun rods of old style design tend to have straight stock handles coaxially oriented and formed as part of an end rod section for pushing an accessory through the barrel. Some gun owners prefer a straight stock or "push" handle to a palm-rest or "pull" handle. Conventional cleaning rod handles are of one type or the other.

Gun care and maintenance may also require disassembly and reassembly of gun components, often requiring the use of screwdrivers or similar implements. Screwdrivers may also be needed in the field for adjusting sight alignments, and tightening scope bases, action screws, trigger guard retaining screws, recoil pad screws, butt plate screws, etc. An assortment of such tools may need to be carried to meet various needs that may arise.

SUMMARY OF THE INVENTION

The present invention provides a multipurpose handle for use in combination with a gun cleaning rod to serve as either a palm-rest, T-type "pull" handle or as a straight stock, "push" handle, as determined by the user, and which further provides a socket handle for driving screwdriver and similar tool bits.

In one aspect of the invention, a handle is provided comprising an elongated body member having a coaxial threaded bore at one end for threaded engagement with a cleaning rod section to function as a "push" handle; an axially perpendicular threaded bore at its center for threaded engagement with a cleaning rod section to function as a "pull" handle; and a socket opening at its other end for releasably retaining screwdriver or similar tool bits therein and for functioning as a handle therefor. An axially perpendicular smooth throughbore located intermediate the member ends at a point spaced from the central bore provides a passage through which to optionally slide a cleaning rod section in order to lengthen the moment arm for applying additional torque to the retained bit.

In a preferred embodiment of the invention, described in greater detail below, the socket opening is a coaxially-aligned hexagonal opening at whose interior end is positioned a magnet which releasably retains the bit in the socket and serves to magnetize the bit for holding metal screws and similar components thereon.

BRIEF DESCRIPTION OF THE DRAWINGS

An embodiment of the invention has been chosen for purposes of illustration and description, and is shown in the accompanying drawings, wherein:

FIG. 1 is a longitudinal section view of one embodiment of the invention; and FIGS. 2–4 are view useful in understanding the different functions of the embodiment of FIG. 1.

Throughout the drawings, like elements are referred to by like numerals.

DESCRIPTION OF THE PREFERRED EMBODIMENT

The principles of the invention are described with reference to a gun cleaning rod handle 10, a longitudinal cross-section of which, taken through a central axis 12, is shown in FIG. 1.

As illustrated, the handle 10 is comprised of a elongated body member in the form of a cylindrical metal rod 14 having a first coaxially aligned hole or bore 15 at one end and a second central hole or bore 16 located midway between the ends of member 10 and perpendicularly aligned with the axis 12. The bores 15 and 16 are internally threaded and are dimensioned and configured for receiving a complementary threaded end of a gun cleaning rod section 18 (see FIGS. 2–4, discussed below) therein.

A socket opening 19 is advantageously formed at the end opposite the bore 15 of the rod 14, preferably in a coaxially aligned hexagonal socket configuration, as shown in FIG. 1. The socket opening 19 serves to receive the matching shank end of a screwdriver or other hexagonal tool bit 20 (see FIG. 4) therein. Means, such as the magnet 21 shown located at the bottom of the opening 19, is provided on the handle 10 for releasably retaining the tool bit 20 within the opening 19.

A third bore 23 (FIG. 1) is located intermediate the ends of the rod 14, spaced from the second bore 16, and perpendicularly aligned relative to axis 12. A suitable configuration has the bore 23 located midway between the bore 16 and the bore 15 end of rod 14, as shown. The bore 23 is preferably unthreaded and smooth. It extends completely through the member 10 and is dimensioned and configured to permit a smooth midportion of a cleaning rod section 18 to be received therein.

By way of example, the bore 15 may be drilled and tapped to present an #8×32 TPI (or other appropriate thread size) threaded channel of sufficient depth to releasably securely engage a standard #8×32 TPI (or other appropriate thread size) end of a conventional cleaning rod section 18 in coaxial alignment with the rod 14, thereby allowing the handle 10 to be used as a "push" handle as shown in FIG. 2. The bore 16 may likewise be drilled and tapped to present an #8×32 TPI (or other appropriate thread size) channel so that the same rod 18 may be brought into threaded engagement with the center of the handle 10, perpendicularly aligned with the axis 12, thereby allowing the handle 10 to be used as a "pull" or "T" handle, as shown in FIG. 3.

The socket opening 19 at the other end of the rod 14 may be hammer forged, swaged, or broached into a ¼" hexagonal socket configuration which will accept any standard hardened screwdriver bit or other tool bit 20 having a ¼" hexagonal shank, thereby allowing the handle 10 to be used as a tool bit drive handle, as shown in FIG. 4. The bore 23 may be an untapped hole having an inside diameter slightly larger than the outside diameter of the cleaning rod section 18, which will allow a user to slide the rod section 18 through the hole 23, converting the handle 10 to a "T" wrench for the application of additional torque when using it as a tool bit drive handle.

The bottom of the opening 19 may be bored out to accommodate a piece of permanent magnet 21 which is epoxied or otherwise suitably fastened therein. The magnet 21 at the bottom of the hexagonal socket opening 19 will prevent the screwdriver bit 20 from falling out of the socket, and also enables the bit 20 by magnetization to hold steel screws in proper alignment for starting them into threaded holes (i.e. act as a screw starter).

Although the magnet 21 is an advantageous way of releasably retaining a tool bit 20 within the socket opening 19, a spring steel ring in a groove or other means may also be utilized. Also, although the bore 16 is shown as a throughbore to permit attachment of the rod section 18 into either end of the bore 16, the bore 16 can be made with just one outlet. To enhance the user's ability to grip the handle 10 during operation, knurled bands 25 may optionally be inscribed on the gripped surfaces of the rod 14.

It will be appreciated by those skilled in the art to which the invention relates that other various substitutions and modifications may be made to the illustrated embodiment, without departing from the spirit and scope of the invention as defined by the claims below.

I claim:

1. A multipurpose handle for use in cooperation with a gun cleaning rod and tool bit, comprising:

an elongated body member having a longitudinal axis and two ends;

a first bore formed at one end of the member in coaxial alignment with the axis;

a second bore formed centrally of the member in perpendicular alignment with the axis;

a socket opening formed at the other end of the member;

a third bore formed intermediate the ends of the member and spaced from the second bore, the third bore extending through the member in perpendicular alignment with the axis;

means on the handle for releasably retaining the tool bit within the socket opening;

the first and second bores being dimensioned and configured for matingly engaging a complementary end of the rod, the first bore enabling the handle to serve as a "push" handle for the rod, the second bore enabling the handle to serve as a "pull" handle for the rod;

the socket opening enabling the handle to serve as a driver handle for the bit; and the third bore being dimensioned and configured for receiving a midportion of the rod therein, for applying additional torque to the bit when the handle serves as the handle.

2. A handle as in claim 1, wherein the socket opening comprises a hexagonal socket opening for receiving a complementary hexagonal end of the tool bit therein.

3. A handle as in claim 1, wherein the tool bit retaining means comprises a magnet.

4. A handle as in claim 1, wherein the member is externally knurled to increase its capability to be securely gripped.

5. A multipurpose handle for use in cooperation with a gun cleaning rod and a tool bit, comprising:

a cylindrical body member having a longitudinal axis and two ends;

a first bore formed at one end of the member in coaxial alignment with the axis;

a second bore formed centrally of the member in perpendicular alignment with the axis;

a hexagonal socket opening formed at the other end of the member in coaxial alignment with the axis;

a third bore extending through the member between the second bore and one of the ends in perpendicular alignment with the axis; and means located for the handle within the socket opening for releasably retaining a complementary hexagonal portion of the tool bit within the opening;

the first and second bores being internally threaded and being dimensioned and configured for matingly engaging a complementary externally threaded end of the rod, the first bore enabling the handle to serve as a "push" handle for the rod, the second bore enabling the handle to serve as a "pull" handle for the rod, and the socket opening enabling the handle to serve as a driver handle for the bit; and the third bore being internally smooth and being dimensioned and configured for receiving a midportion of the rod therein for applying additional torque to the bit when the handle serves as a driver handle.

6. A handle as in claim 5, wherein the tool bit retaining means comprises a magnet located at the bottom of the socket opening.

7. A handle as in claim 6, wherein the member is externally knurled to increase its capability to be securely gripped.

8. A gun care and maintenance tool, comprising:

cleaning rod having a section with an externally threaded end; and a handle comprising an elongated member having a longitudinal axis and two ends; a first bore formed at one end in coaxial alignment with the axis and a second bore formed centrally of the member in perpendicular alignment with the axis; the first and second bores being internally threaded and being dimensioned and configured for threaded interengagement with the end of the cleaning rod section, the first bore enabling the handle to cooperate with the section to serve as a "push" handle for the rod and the second bore enabling the handle to cooperate with the section to serve as a "pull" handle for the rod; and wherein the handle member is further formed with a third bore intermediate its ends and spaced from the second bore, the third bore extending through the member in perpendicular alignment with the axis, and being dimensioned and configured for receiving a midportion of the rod section therein to enable the rod to cooperate with the handle to extend the moment arm for applying torque to the bit when the handle is used to serve as a driver handle.

9. A tool as in claim 8, further comprising a screwdriver bit having a shank portion; and the handle member being further formed with a socket opening at the other end of the member, and having means for releasably retaining the shank portion of the bit within the socket opening, the socket opening enabling the handle to cooperate with the shank portion to serve as a driver handle for the bit.

10. A tool as in claim 9, wherein the shank portion is a hexagonal shank portion and the socket opening is a hexagonal socket opening in coaxial alignment with the member axis.

11. A tool as in claim 10, wherein the third bore is located between the first bore end of the member and the second bore.

12. A tool as in claim 10, wherein the bit retaining means comprises a magnet located at the bottom of the socket opening.

13. A tool as in claim 10, wherein the handle member is externally knurled to increase its capability to be securely gripped.

* * * * *